US007464788B2

(12) United States Patent
Alex et al.

(10) Patent No.: US 7,464,788 B2
(45) Date of Patent: Dec. 16, 2008

(54) APPARATUS FOR TRANSMITTING SOUND IN A MOTOR VEHICLE

(75) Inventors: Matthias Alex, Heilbronn (DE); Frank Pfeiffer, Moensheim (DE)

(73) Assignee: Mann & Hummel GmbH, Ludwigsburg (DE)

( * ) Notice: Subject to any disclaimer, the term of this patent is extended or adjusted under 35 U.S.C. 154(b) by 190 days.

(21) Appl. No.: 11/211,727

(22) Filed: Aug. 26, 2005

(65) Prior Publication Data

US 2006/0042873 A1 Mar. 2, 2006

(30) Foreign Application Priority Data

Aug. 28, 2004 (DE) ..... 10 2004 041 699

(51) Int. Cl.

| | |
|---|---|
| ***F01N 1/02*** | (2006.01) |
| ***F01N 1/20*** | (2006.01) |
| ***G08B 3/02*** | (2006.01) |
| *F01N 1/16* | (2006.01) |
| *F02M 35/104* | (2006.01) |

(52) U.S. Cl. ..... 181/250; 181/278; 123/184.53; 123/184.57; 340/384.3

(58) Field of Classification Search ..... 181/250, 181/144, 145, 271, 156, 277, 278; 123/184.59, 123/184.57, 184.21, 184.53; 340/384.3
See application file for complete search history.

(56) References Cited

U.S. PATENT DOCUMENTS

| | | | | |
|---|---|---|---|---|
| 4,577,495 | A * | 3/1986 | Bamer | 73/118.2 |
| 4,618,025 | A * | 10/1986 | Sherman | 181/148 |
| 4,953,655 | A * | 9/1990 | Furukawa | 181/160 |
| 6,551,389 | B2 * | 4/2003 | Spannbauer et al. | 96/380 |
| 6,644,436 | B2 * | 11/2003 | Hofmann et al. | 181/214 |
| 6,932,189 | B2 * | 8/2005 | Helber et al. | 181/240 |
| 2002/0157897 | A1 * | 10/2002 | Hofmann et al. | 181/214 |
| 2003/0057015 | A1 * | 3/2003 | Helber et al. | 181/240 |
| 2005/0121255 | A1 * | 6/2005 | Hofmann et al. | 181/250 |
| 2005/0121256 | A1 * | 6/2005 | Hofmann et al. | 181/271 |
| 2005/0133300 | A1 * | 6/2005 | Hofmann et al. | 181/250 |

FOREIGN PATENT DOCUMENTS

| | | | |
|---|---|---|---|
| EP | 1 306 829 | A2 | 5/2003 |
| EP | 1748420 | A2 * | 1/2007 |
| JP | 58091328 | A * | 5/1983 |
| JP | 2003262166 | A * | 9/2003 |

* cited by examiner

*Primary Examiner*—Edgardo San Martin
(74) *Attorney, Agent, or Firm*—Crowell & Moring LLP

(57) ABSTRACT

An apparatus for transmitting sound in a motor vehicle having a housing (1) with an inner partition (2), which together define two separate subspaces (3, 4). A transmission valve (6) which separates the two subspaces (3, 4) is provided in a pivot bearing opening (9) in the partition (2) and is mounted to pivot about a pivot axis (5) in the area of the pivot bearing opening (9). The first subspace (3) is connected in a manner capable of transmitting sound to an intake manifold (17) of an internal combustion engine, and the second subspace (4) is connected in a manner capable of transmitting sound to an interior space of the motor vehicle. The gap (11) between an edge (10) of the pivot bearing opening (9) and the transmission valve (6) is sealed in a pressure-tight manner by a membrane (12).

9 Claims, 3 Drawing Sheets

APPARATUS FOR TRANSMITTING SOUND IN A MOTOR VEHICLE

BACKGROUND OF THE INVENTION

The present invention relates to a device for sound transmission in a motor vehicle.

The propulsion motors of modern motor vehicles are very smooth-running internal combustion engines which generate operating noise that is hardly audible in the interior of the vehicle. Under some circumstances, the operating noise of the internal combustion engine is audible through the secondary noise of the turning wheels, a ventilation system that is turned on, etc. Under certain circumstances, it may be desirable to audibly transmit the operating noise of the driving engine into the interior of the vehicle.

Published European patent application no. EP 1,306,829 describes a device for transmitting the noise of an internal combustion engine in which a housing having a partition delimits or defines two separate subspaces. The partition is interrupted by a pivotable valve which separates the two subspaces. The first subspace is connected to the intake manifold of the internal combustion engine, while the second subspace leads to a wall of the vehicle or directly into the interior of the vehicle. In the first subspace, sound pressure vibrations in the intake manifold act on the half of the transmission valve which protrudes into that space and is thereby excited to execute a pivoting movement. In the second subspace, the vibrating pivoting movement of the transmission valve results in transmission of sound to the interior of the vehicle.

The subspace connected to the intake manifold may have a static mean pressure which differs from that of the subspace connected to the interior of the vehicle. To maintain this static pressure difference, a seal is maintained on the gap between the axis of rotation of the transmission valve and the edges of the adjacent partition. Therefore, the valve has on both sides an axially parallel web that is held with pressure between rubber gaskets of the partition to form a seal. The pressure in combination with the comparatively rigid sealing material prevents the transmission valve from pivoting freely. Resonance is attenuated. The potential of the arrangement described there is not fully utilized with regard to the efficiency that can be achieved in sound transmission.

SUMMARY OF THE INVENTION

It is an object of the present invention provide an improved device for transmitting sound in a motor vehicle.

Another object is to provide a device for transmitting sound in a motor vehicle in which sound transmission is achieved with an increased efficiency.

These and other objects are achieved in accordance with the present invention by providing an apparatus for transmitting sound in a motor vehicle, the apparatus comprising a housing with an inner partition which together define two separate subspaces, and a transmission valve disposed in a pivot bearing opening in the partition separating the two subspaces and mounted to pivot about a pivot axis in the area of the pivot bearing opening; wherein one of the subspaces is connected to an intake manifold of an internal combustion engine, the other of the subspaces is connected to an interior space of the motor vehicle in a manner capable of transmitting sound, and a gap between an edge of the pivot bearing opening and the transmission valve is sealed in a pressure-tight manner by a membrane.

A device for sound transmission in a motor vehicle is proposed having a transmission valve pivotably mounted in a pivot bearing opening in the partition. A gap provided between an edge of the pivot bearing opening and the transmission valve is sealed by a membrane in a pressure-tight manner. In the context of the present invention, the term "membrane" refers to a thin flat component having a certain rigidity at least approximately only in the plane of the membrane but which is flexible in the perpendicular direction. The membrane reliably covers the gap in the pivot bearing opening in a pressure-tight manner, thereby precluding the possibility of an equalization of pressure between the two subspaces in the device. The fact that there is virtually no bending rigidity or torsional rigidity of the membrane or it is at least negligible results in an almost complete mechanical separation of the pivotable transmission valve from the stationary housing. The area of the transmission valve near the axis is sealed without any mechanical interaction with the valve. The transmission valve thus can vibrate freely and transmit sound with improved efficiency.

In one advantageous embodiment, the membrane is connected to the transmission valve in a pressure-tight manner along the pivot axis. This allows a flat planar embodiment of the membrane suitable for centering the transmission valve due to its rigidity in the plane of the membrane. At the same time, essentially only a transverse deformation of the membrane is induced via the fastening along the pivot axis when the valve pivots. The longitudinal portion of the deformation in the plane of the membrane is negligible. The transmission valve exhibits improved decoupling from the housing in the axial area.

The gap and the membrane sealing the gap are advantageously arranged in the form of a ring around the cross section of the transmission valve. In addition to sealing the valve surfaces along the pivot axis, there is also a seal in the critical area of the end edge near the axis. The membrane, arranged around the valve in one piece in particular, undergoes a combined torsional and bending deformation in this area with regard to which the membrane is flexible. This results in a peripheral hermetic seal without any impairment of the pivoting movement of the transmission valve.

In advantageous embodiments, the membrane is secured to an outer frame on the housing and/or to an inner frame on the valve. A preassembled membrane module can be produced and installed as a unit by means of this frame or these frames. The frame absorbs the necessary assembly forces, clamping forces or other external forces and keeps them away from the membrane owing to the inherent rigidity of the frame. External forces are kept away from the transmission valve, so that the free mobility of the valve is unaffected.

Advantageously, a torsionally elastic web extending from the inner frame to the outer frame is provided in the area of the pivot axis. In particular, the inner frame and the outer frame are joined in this area by the web and are preferably constructed in one piece with the web. The torsionally flexible web in this case functions as a pivot axis for the transmission valve which ends at the outer frame on the outside and is not guided through the housing or supported in any other form. Leakage in the bearing area is thus prevented. Furthermore, the web has a certain rigidity and/or load-bearing capacity in the transverse direction. Differential pressure acting on the membrane cannot lead to a lateral deflection of the transmission valve across the plane of the membrane. The transmission valve is held accurately in position and can be adjacent to the housing on the outside with minor gap tolerances. The one-piece design as an injection-molded plastic part, for example, further increases the positional accuracy with a reduced manufacturing cost. In particular, the frame unit may also be constructed in one piece with the transmission valve itself. This contributes on the whole to increased imperviousness and thus to increased efficiency with a simplified design.

In an advantageous embodiment, the outer frame is held in a form-fitting manner in a groove at the edge of the pivot bearing opening. This yields the possibility of simplified assembly in that the outer frame is clamped in the corresponding groove sections when the housing parts are joined together. The fact that the outer frame is clamped together in a form-fitting manner creates a good sealing effect within the arrangement and also with respect to the outside, in addition to ensuring precise fixation of the transmission valve in an accurate position. The resulting clamping forces are absorbed by the outer frame and are kept away from the membrane and/or the transmission valve so that their free mobility is ensured.

BRIEF DESCRIPTION OF THE DRAWINGS

The invention will be described hereinafter in further detail with reference to illustrative preferred embodiments depicted in the accompanying drawing figures, in which.

DETAILED DESCRIPTION OF PREFERRED EMBODIMENTS

Figure 1:
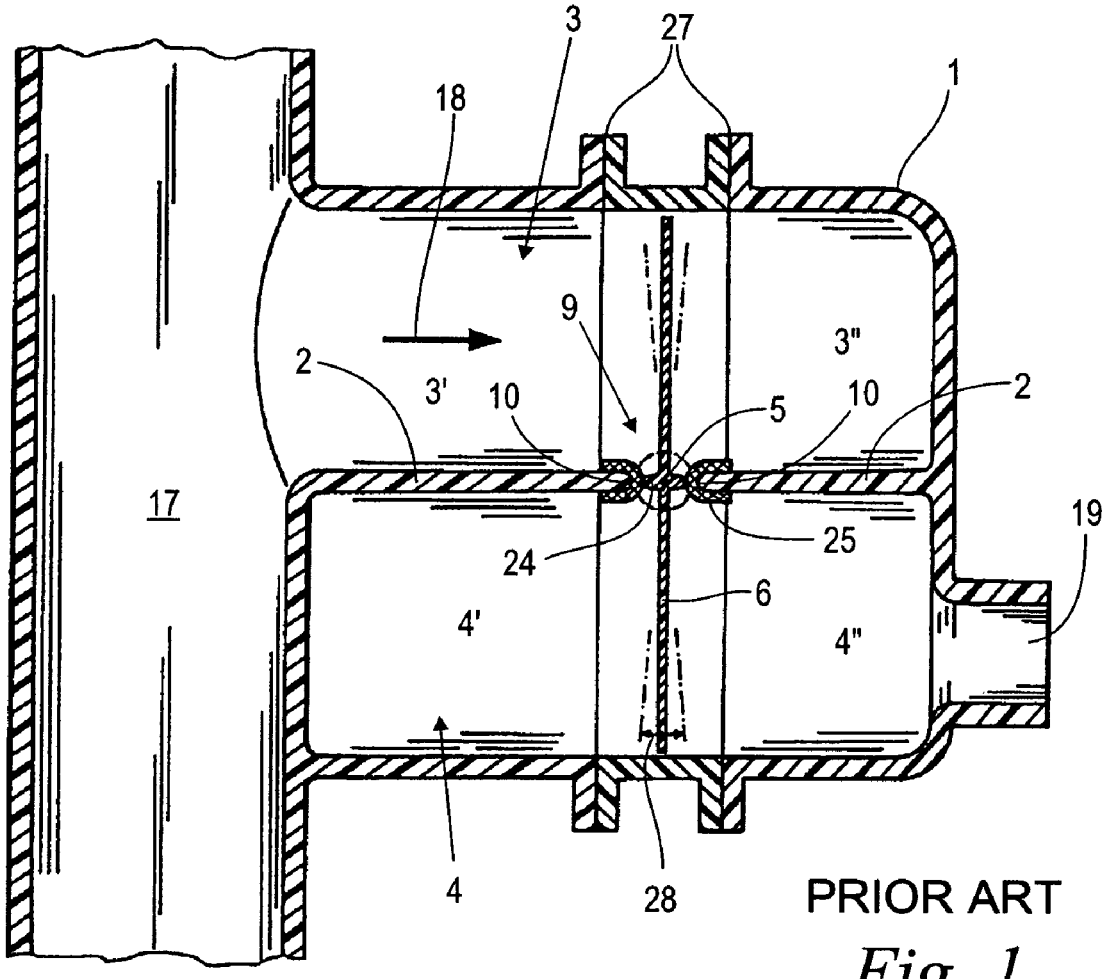
PRIOR ART Fig. 1
FIG. 1 is a schematic longitudinal sectional view of a prior art apparatus for transmitting sound.

FIG. 1 shows a sectional diagram of a prior art device for sound transmission in a motor vehicle. The device includes a housing 1 having an inside partition 2, where the housing 1 and the inside partition 2 define or delimit two separate subspaces 3 and 4. A part of the housing 1 is integrally molded on an intake manifold 17 of an internal combustion engine (not shown) of a motor vehicle, with the first subspace 3 being connected to the interior of the intake manifold 17 in a manner that transmits sound pressure. The partition 2 creates a fluid separation of the first subspace 3 from the second subspace 4.

A transmission valve 6 is provided, disposed in a pivot bearing opening 9 through the partition 2 and mounted to pivot about a pivot axis 5 in the partition 2 and/or in the pivot bearing opening 9. The transmission valve 6 extends on both sides from the pivot axis 5 up to close to the inside wall of the housing 1, forming a small gap and thereby dividing the two subspaces 3, 4 into individual spaces 3', 3", 4', 4". The individual space 4" of the subspace 4 is connected to a wall of the interior of the motor vehicle (not shown) via an outlet 19 in a manner sufficient to transmit sound pressure or is connected directly to the interior.

The transmission valve 6 is shown in its neutral position, from which it can execute an oscillating pivoting movement in the direction of double arrow 28. The pivot range is approximately 10°. The static pressure in the intake manifold 17 acts on the transmission valve 6 on both sides via the gap between the transmission valve 6 and the housing 1 in the first subspace 3 and thus does not have any effect on the deflection of the transmission valve. An oscillating sound pressure in the intake manifold 17 acts on the transmission valve 6 in the direction of an arrow 18 without being able to penetrate through the narrow gap to a significant extent. As a result of the applied oscillating sound pressure, vibration is induced in the transmission valve 6. In the second subspace 4, the vibrating transmission valve 6 causes a similar sound pressure offset by 180° to be created in the individual space 4" and to be rendered audible in the interior of the motor vehicle via the outlet 19.

The transmission valve 6 is supported in a fluid-tight manner in the partition 2. Due to the seal of the two subspaces 3, 4 with respect to one another in combination with the gap between the transmission valve 6 and the housing 1, the arrangement functions independently of the static pressure in the intake manifold 17 and is thus suitable in particular for operation of a supercharged propulsion motor, e.g., in an intake manifold area between a turbocharger and the engine.

To achieve fluid separation between the two subspaces 3, 4, the pivot bearing opening 9 is sealed in the area of the pivot axis 5. To this end, the transmission valve 6 has a web 24 running parallel to the pivot axis 5 on each of its two surfaces. The partition 2 has U-shaped rubber gaskets 25 on its edges 10 of the pivot bearing opening 9. The housing 1 is bolted via flanges 27. Any other suitable joining method, such as gluing or welding, may also be used. In the assembly process and/or in the case of a screw connection at the flanges 27, the rubber gaskets 25 are pressed with a seal against the respective web 24 by the two halves of the partition 2. The sealing effect depends on the pressing force applied which in turn influences and/or impairs the pivotability of the transmission valve 6 in combination with the rigidity of the rubber gaskets 25.

Figure 2:
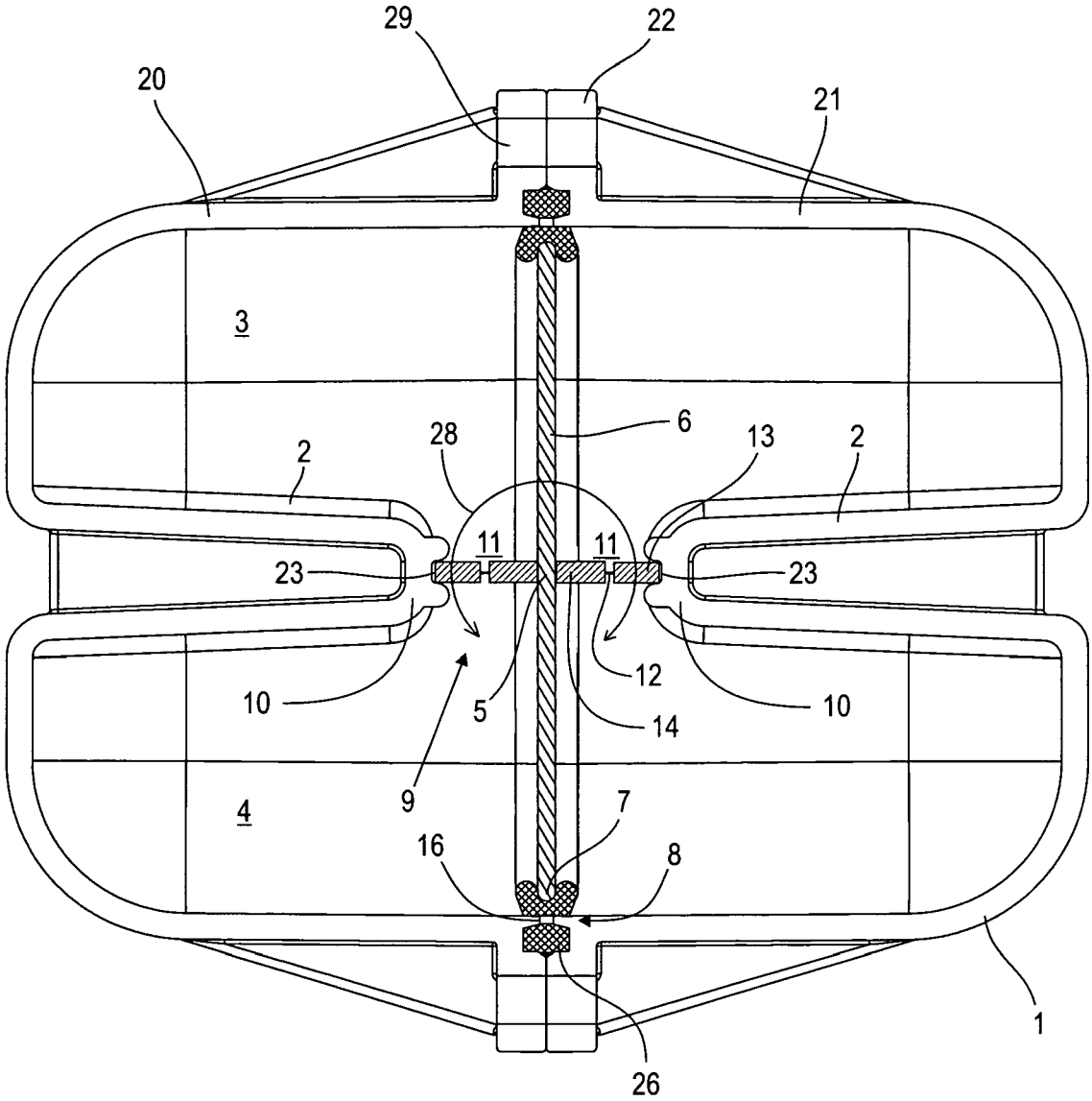
FIG. 2 is a sectional diagram of a device for sound transmission constructed according to this invention with a membrane in the area of the pivot bearing opening.

According to FIG. 2, an inventive embodiment of the device for sound transmission is provided, the basic principle of this design being explained on the basis of the arrangement according to FIG. 1. The housing 1 consists of two housing halves 20, 21, and the partition 2 is integrally molded in one piece onto each half. The housing halves 20, 21 are joined together with screws on the flange 22.

The transmission valve 6 is held along its peripheral edge 7 in the elastic rubber frame 26 which also runs around the periphery. The frame 26 has an interior groove in which the transmission valve 6 is held in a form-fitting manner. In the outer area the frame 26 is secured and/or clamped in the flange 22 between the two housing halves 20 and 21. The two housing halves 20 and 21 are bolted together through the screw holes 29 in the flange 22, thereby securing the frame 26.

The frame 26 is designed in two parts such that its outer area is attached to the housing 1 and its inner area is attached to the transmission valve 6, forming a gap 16 between them. The frame 26 here forms a sealing element 8 between the peripheral edge 7 of the transmission valve 6 and the inside wall of the housing 1, with the gap 16 allowing free pivotability of the transmission valve 6.

The facing edges of the two halves of the partition 2 are spaced a distance from one another and from the pivot axis 5 of the transmission valve 6. This creates a pivot bearing opening 9 which forms a gap 11 on both sides of the transmission valve 6 along its pivot axis 5. The gap 11 is bordered by the surface of the transmission valve 6 and to the outside by an edge 10 of the pivot bearing opening 9. The edge 10 here corresponds to the free end of the respective section of the partition 2 facing inward. The gap 11 is sealed on both sides of the transmission valve 6 by a membrane 12 in a pressure-tight connection.

The membrane 12 may be constructed like folded bellows, with corrugations, or in some other spatial embodiment. In the illustrative embodiment shown here, it is planar. On the side facing the transmission valve 6, the membrane is secured on an inner frame 14, running directly along the pivot axis 5 on the outside of the transmission valve 6. Due to the planar design, the membrane 12 is rigid in its plane and secures the transmission valve 6 in the plane of the membrane and/or in the plane of the partition 2.

It may also be advantageous to secure the position of the transmission valve 6 with an axial journal or the like. In the case of three-dimensional molding of the membrane 12, it may also be connected in a pressure-tight seal to the transmission valve 6 beyond the pivot access 5.

Within the scope of the present invention, the membrane 12 is defined as a thin, flat structure which is essentially flexible in the direction across its plane. Depending on the application, the membrane 12 may be made of a rubber film, a cloth film or a plastic film or even metal foil, i.e., a thin sheet of metal, to achieve the corresponding mechanical properties.

The membrane 12, which is flexible across its plane, allows a pivoting movement of the transmission valve in the direction of the double arrow 28 despite its lateral fixation of the transmission valve 6. The membrane 12 here experiences essentially a bending deformation across the plane of the membrane. In this direction, the membrane 12 is essentially flexible. It may also be advantageous to provide the membrane 12 with a defined residual rigidity in the bending direction. In combination with a small-area design of the gap 11, the membrane 12 may also be used to secure the position of the transmission valve 6 across the plane of the membrane. The design of separate axle journals or other elements to guide the pivoting movement may also be omitted here, if necessary.

The membrane 12 is attached to an outer frame 13 on the housing end, this outer frame in turn being secured in a groove 23 at the edge 10 of the pivot bearing opening 9 and thus attached in a form-fitting manner to the partition 2. In the case of a screw connection of the two housing halves 20, 21 on the flange 22, the structural unit of the transmission valve 6 is also attached by clamping to the membrane 12 and the outer frame 13 in addition to the frame 26. The clamping force of the screw connection on the flange 22 results in a pressure-tight clamping of the outer frame 13 in the groove 23.

Figure 3:
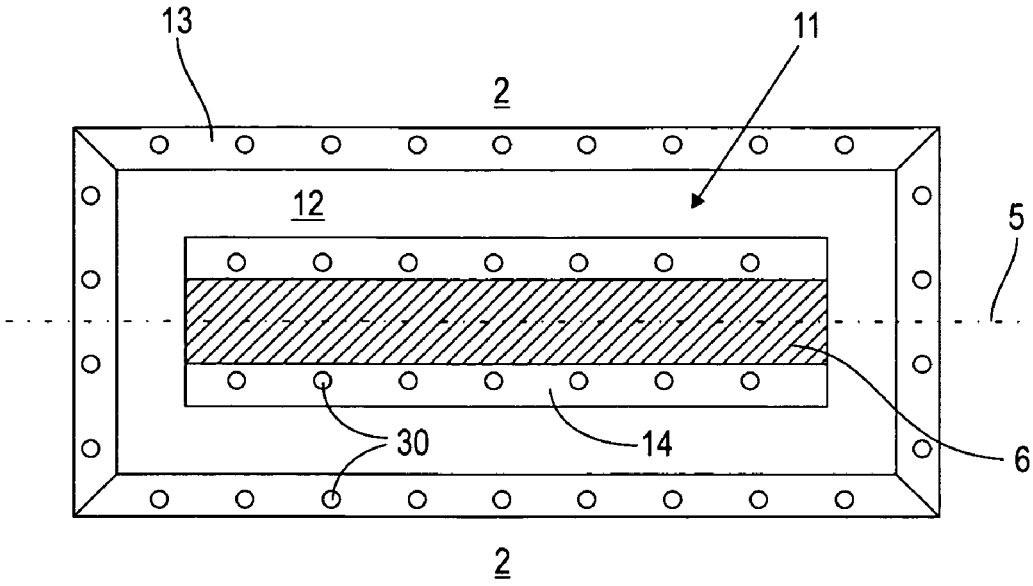
FIG. 3 is a schematic diagram showing the membrane according to FIG. 2 as viewed from above and with the transmission valve in cross section.

FIG. 3 shows a schematic diagram of a cross section through the transmission valve 6 in the area of the pivot axis 5; whereby the selected view also represents a top plan view of the membrane 12. It can be seen here that the gap 11 and also the membrane 12 sealing the gap 11 in the illustrative embodiment shown here are arranged in an annular shape around the cross section of the transmission valve 6. The membrane 12 is attached on the inside to the inner frame 14 and on the outside to the outer frame 13, for which purpose the fastening points 30 indicated in the drawing are provided. The inner frame 14 is attached in a pressure-tight manner to the transmission valve 6, and the outer frame 13 is attached in a pressure-tight manner to the housing 1 (FIG. 2). In addition, the membrane 12 is attached in a pressure-tight manner to the outer frame 13 and to the inner frame 14, thus hermetically sealing the peripheral gap 11 in its entirety.

The material of the membrane 12 has a rigidity such that, in combination with the planar design of the membrane 12, the transmission valve 6 is accurately secured in position in each lateral direction in the plane of the membrane as shown here, although pivotability about the pivot axis 5 is allowed. The arrangement of a separate axial component or the like has been omitted.

Figure 4:
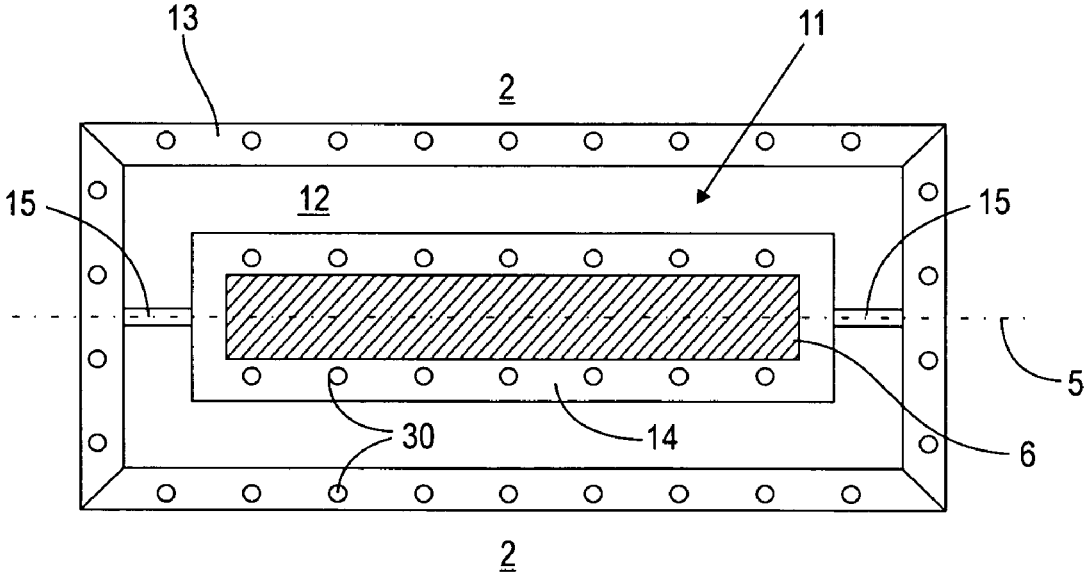
FIG. 4 is a variant of the arrangement according to FIG. 3 with a web integrally molded in one piece between the outer frame and the inner frame of the membrane.

FIG. 4 shows a variant of the arrangement according to FIG. 3 in which a torsionally elastic web 15 is provided on each side of the end edges of the transmission valve running along the pivot axis 5. The torsionally elastic web 15 runs from the end edge of the transmission valve 6 and/or the section of the inner frame 14 situated there up to the outer frame 13. The two torsionally elastic webs 15 form axis elements for guiding the transmission valve 6 in its pivoting movement about the pivot axis 5 by subjecting them to a torsional deformation in the corresponding pivoting movement, like the adjacent area of the membrane 12. At the same time, due to the bending rigidity and transverse rigidity, the webs 5 yield an improved means of securing the position of the transmission valve 6 perpendicular to the plane of the membrane 12.

In the illustrative embodiment depicted here, the inner frame 14, the webs 15 and the outer frame 13 are constructed as a one-piece injection-molded plastic component. It may also be advantageous, for example, to additionally manufacture the membrane 12 and the transmission valve 6 by injection molding so that they are embodied in one piece with the aforementioned components.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variation within the scope of the appended claims and equivalents thereof.

What is claimed is:

1. An apparatus for transmitting sound in a motor vehicle, said apparatus comprising a housing with an inner partition which together define two separate subspaces, and a transmission valve disposed in a pivot bearing opening in said partition separating the two subspaces and mounted to pivot about a pivot axis in the area of the pivot bearing opening; wherein one of said subspaces is connected to an intake manifold of an internal combustion engine, the other of said subspaces is connected to an interior space of the motor vehicle in a manner capable of transmitting sound, and a gap between an edge, corresponding to a free end of the respective section of the partition facing inward, of the pivot bearing opening and the transmission valve is sealed on both sides of the transmission valve in a pressure-tight manner by a membrane that is rigid in its plane and secures the transmission valve in at least one of the plane of the membrane and the plane of the partition.

2. An apparatus according to claim 1, wherein the membrane is connected to the transmission valve in a pressure-tight manner along the pivot axis.

3. An apparatus according to claim 1, wherein said gap and the membrane which seals the gap are arranged in an annular configuration around the cross section of the transmission valve.

4. An apparatus according to claim 1, wherein the membrane is secured to an outer frame on the housing.

5. An apparatus according to claim 1, wherein the membrane is secured to an inner frame on the valve.

6. An apparatus according to claim 1, wherein the membrane is secured to an outer frame on the housing and to an inner frame on the valve, and a torsionally elastic web extending from the inner frame to the outer frame is provided in the area of the pivot axis.

7. An apparatus according to claim 6, wherein the inner frame and the outer frame are joined by the web.

8. An apparatus according to claim 7, wherein the inner frame and the outer frame are constructed in one piece together with the web.

9. An apparatus according to claim 4, wherein the outer frame is held in a form-fitting manner in a groove at the edge of the pivot bearing opening.

* * * * *